US010619387B2

(12) United States Patent
Ou et al.

(10) Patent No.: US 10,619,387 B2
(45) Date of Patent: Apr. 14, 2020

(54) HANDLE SET HAVING LATCH BOLT ACTUABLE BY PUSHING HANDLE

(71) Applicant: HAMPTON PRODUCTS INTERNATIONAL CORPORATION, Foothill Ranch, CA (US)

(72) Inventors: Xinmin Ou, Zhuhai (CN); Duane Luke, Anaheim Hill, CA (US); Jon Fong Quan, Fountain Valley, CA (US); Steven T. Weathersby, Lake Forest, CA (US); Hossein Molaie Shargh, Santa Margarita, CA (US); Feilong Liang, Zhuhai (CN); Hangui Xiao, Zhuhai (CN); Guohua Liu, Zhuhai (CN); Jian Wen, Zhuhai (CN); Xinben Ou, Zhuhai (CN); Zhiman Yuan, Zhuhai (CN)

(73) Assignee: Hampton Products International Corporation, Foothill Ranch, CA (US)

( * ) Notice: Subject to any disclaimer, the term of this patent is extended or adjusted under 35 U.S.C. 154(b) by 422 days.

(21) Appl. No.: 15/506,687

(22) PCT Filed: Sep. 5, 2014

(86) PCT No.: PCT/CN2014/086038
§ 371 (c)(1),
(2) Date: Feb. 24, 2017

(87) PCT Pub. No.: WO2016/033804
PCT Pub. Date: Mar. 10, 2016

(65) Prior Publication Data

US 2018/0058117 A1 Mar. 1, 2018

(51) Int. Cl.
*E05C 1/14* (2006.01)
*E05B 1/00* (2006.01)
(Continued)

(52) U.S. Cl.
CPC ..... *E05C 1/14* (2013.01); *E05B 1/0007* (2013.01); *E05B 1/0038* (2013.01); *E05B 7/00* (2013.01); *E05C 1/166* (2013.01)

(58) Field of Classification Search
CPC ... E05C 1/14; E05C 1/16; E05C 3/162; E05C 5/02; Y10T 292/0972; Y10T 292/0995;
(Continued)

(56) References Cited

U.S. PATENT DOCUMENTS 1,876,081 A 9/1932 Schlage
1,888,828 A 11/1932 Moore
(Continued)

FOREIGN PATENT DOCUMENTS

CN 1223328 7/1999
CN 1255181 5/2000
(Continued)

OTHER PUBLICATIONS

Office Action on co-pending Canadian patent application (CA 2959255) dated Jan. 18, 2018.
(Continued)

*Primary Examiner* — Mark A Williams
(74) *Attorney, Agent, or Firm* — Klein, O'Neill & Singh, LLP

(57) ABSTRACT

A handle set (30) comprises an elongated handle (40) that is attached to a corresponding door (32) at two spaced apart locations. A knob (42) is disposed on the door (32) opposite the handle (40). A retractor assembly (80) is interposed between the handle (40) and the knob (42). A handle spindle (62) extends from the handle (40), and a knob spindle (60) extends from the knob (42). The handle and knob spindle overlap one another, and are configured to move axially with one another. However, the knob spindle (60) can be rotated relative to the handle spindle (62). The spindles are config-
(Continued)

ured to interact with the retractor assembly (80) so that pushing the handle (40) or pulling the knob (42) actuates the retractor to withdraw the latch bolt (50), or rotating the knob (42) actuates the retractor to withdraw the latch bolt (50).

21 Claims, 14 Drawing Sheets

(51) Int. Cl.
*E05B 7/00* (2006.01)
*E05C 1/16* (2006.01)

(58) Field of Classification Search
CPC ..... Y10T 292/0986; E05B 1/0038; E05B 1/0092; E05B 13/105; E05B 63/22
See application file for complete search history.

(56) References Cited

U.S. PATENT DOCUMENTS 1,938,112 A 12/1933 Schlage
1,965,789 A 7/1934 Anglyn
1,967,152 A 7/1934 Lyons
2,175,791 A 10/1939 Brauning
2,267,939 A 12/1941 McKenzie
2,370,646 A 3/1945 Falk
2,424,782 A 7/1947 Voight et al.
2,688,181 A 9/1954 Livermont et al.
2,801,536 A 8/1957 Best
2,862,379 A 12/1958 Schafer
2,895,322 A 7/1959 Pollock
3,035,432 A 5/1962 De Vines
3,065,014 A 11/1962 Russell
3,128,115 A 4/1964 Patriquin et al.
3,161,036 A 12/1964 Himes et al.
3,385,622 A * 5/1968 Winger ..... E05C 1/14 292/170
3,490,803 A * 1/1970 Rollins ..... E05C 1/14 292/170
3,495,861 A 2/1970 Snow
3,518,854 A 7/1970 Krantz
3,582,121 A * 6/1971 Rollins ..... E05C 1/12 292/170
3,877,263 A 4/1975 Strickler, III et al.
3,899,907 A 8/1975 Prahl
4,101,153 A 7/1978 Dozier
4,290,282 A 9/1981 Wildenradt
4,453,753 A 6/1984 Fayerman et al.
4,573,334 A 3/1986 Crepinsek
4,632,439 A 12/1986 Miller
4,671,089 A 6/1987 Fleming et al.
4,763,935 A 8/1988 Bisbing
4,777,810 A 10/1988 Webster
4,976,480 A 12/1990 Dixon et al.
4,982,986 A 1/1991 Gressett, Jr. et al.
5,026,101 A 6/1991 Dotterweich et al.
5,029,916 A * 7/1991 Chiu ..... E05B 1/0038 292/170
5,085,474 A 2/1992 Toledo et al.
5,094,486 A 3/1992 Foster
5,157,953 A * 10/1992 Hung ..... E05B 63/22 292/170
5,301,526 A 4/1994 Fann et al.
5,322,333 A 6/1994 Norton, II et al.
5,364,139 A 11/1994 Bergen et al.
5,460,419 A 10/1995 Castoldi
5,469,725 A 11/1995 Yamada
5,481,890 A 1/1996 Millman
5,516,163 A * 5/1996 Baker ..... E05C 1/14 292/165
5,533,368 A 7/1996 Eagan
5,605,064 A 2/1997 Katayama et al.
5,727,406 A 3/1998 Banducci
5,761,936 A 6/1998 Kayayama
5,921,117 A 7/1999 Illguth
5,934,117 A 8/1999 Shen
5,947,535 A 9/1999 Baker
5,947,537 A 9/1999 Aigner et al.
5,983,683 A 11/1999 Shen
6,035,492 A 3/2000 Warshaviak
6,131,970 A 10/2000 Hurst et al.
6,141,998 A 11/2000 Seo
6,223,572 B1 5/2001 Marttinen
6,279,360 B1 8/2001 Shen
6,302,457 B1 10/2001 Shen
6,322,113 B1 11/2001 Ayers et al.
6,354,119 B1 3/2002 Molzer
6,360,569 B1 3/2002 Huang
6,364,383 B1 4/2002 Shen
6,386,602 B1 5/2002 Lan
6,553,799 B2 4/2003 Bates et al.
6,619,710 B1 9/2003 Hwang
6,802,194 B1 10/2004 Shen
6,833,120 B2 12/2004 Collins et al.
6,868,705 B2 3/2005 Miao
6,997,024 B2 2/2006 Etlicher
7,100,406 B2 9/2006 Masseth, Jr.
7,100,407 B2 9/2006 Chen
7,712,343 B2 5/2010 Smith et al.
8,240,177 B2 8/2012 Baser
8,449,003 B2 5/2013 Bunker, II et al.
8,505,345 B2 8/2013 Sun et al.
8,690,205 B2 4/2014 Benitez et al.
8,813,530 B2 8/2014 Chiou et al.
9,121,200 B2 * 9/2015 Weathersby ..... E05B 63/16
9,212,507 B2 12/2015 Ou et al.
9,371,671 B2 6/2016 Weathersby
9,447,610 B2 9/2016 Ou et al.
9,556,644 B2 1/2017 Yoon et al.
2002/0100301 A1 8/2002 Eller et al.
2002/0104345 A1 8/2002 Wang
2003/0037582 A1 2/2003 Edwards, Jr. et al.
2003/0056556 A1 3/2003 Park et al.
2003/0121300 A1 7/2003 Wang
2005/0126236 A1 6/2005 Romero
2006/0079294 A1 4/2006 Chen
2006/0185409 A1 8/2006 Sun et al.
2006/0214436 A1 9/2006 Wheatland et al.
2007/0096479 A1 5/2007 Lin et al.
2008/0168809 A1 7/2008 Liu et al.
2008/0307836 A1 12/2008 Kim et al.
2009/0078011 A1 3/2009 Avni
2009/0152875 A1 6/2009 Gray et al.
2009/0288459 A1 11/2009 Liu et al.
2010/0139335 A1 6/2010 Constantinou
2010/0307207 A1 12/2010 Vogel et al.
2011/0225770 A1 9/2011 Alber
2011/0289987 A1 12/2011 Chiou et al.
2012/0212001 A1 8/2012 Benitez et al.
2012/0267907 A1 10/2012 Rudhager et al.
2013/0200636 A1 8/2013 Hagemeyer et al.
2013/0269402 A1 10/2013 Vasudevan
2014/0047875 A1 2/2014 Weathersby
2014/0157843 A1 6/2014 Quan et al.
2014/0265376 A1 9/2014 Walls et al.
2014/0361552 A1 * 12/2014 Hartford ..... E05C 1/14 292/163
2015/0042106 A1 * 2/2015 Kim ..... E05B 63/06 292/137
2015/0145266 A1 * 5/2015 Song ..... E05C 1/14 292/336.3

FOREIGN PATENT DOCUMENTS

CN 2430511 5/2001
CN 2559730 7/2003
CN 2641228 9/2004
CN 2658315 11/2004
CN 2693906 4/2005
CN 101006240 7/2007
CN 201695763 U 1/2011
CN 102758561 10/2012
CN 102777073 11/2012

(56) References Cited

FOREIGN PATENT DOCUMENTS

| | | | |
|---|---|---|---|
| CN | 202755736 | U | 2/2013 |
| CN | 202788202 | U | 3/2013 |
| CN | 202788218 | U | 3/2013 |
| CN | 203308188 | U | 11/2013 |
| CN | 203403726 | U | 1/2014 |
| EP | 1679414 | | 7/2006 |
| EP | 2505750 | | 10/2012 |
| JP | 2013209805 | | 10/2013 |
| TW | M246397 | U | 10/2004 |
| TW | M271068 | U | 7/2005 |
| TW | M434811 | U | 8/2012 |
| TW | M461676 | U | 9/2013 |
| WO | WO2016033793 | | 3/2016 |
| WO | WO2016033805 | | 3/2016 |

OTHER PUBLICATIONS

Non-Final Office Action on co-pending (U.S. Appl. No. 14/933,364) dated Dec. 14, 2017.
Non-Final Office Action on co-pending (U.S. Appl. No. 15/506,690) dated Jun. 11, 2018.
Notice of Allowance on co-pending (U.S. Appl. No. 15/239,055) dated Aug. 30, 2018.
Office Action on co-pending Canadian patent application (CA 2959251) dated Feb. 16, 2018.
Notice of Allowance on co-pending (U.S. Appl. No. 14/933,364) dated Mar. 27, 2018.
Non-Final Office Action on co-pending (U.S. Appl. No. 15/239,055) dated Feb. 7, 2018.
International Search Report on corresponding PCT application (PCT/CN2014/086038) from International Searching Authority (SIPO) dated May 28, 2015.
Written Opinion on corresponding PCT application (PCT/CN2014/086038) from International Searching Authority (SIPO) dated May 28, 2015.
Non-Final Office Action on co-pending (U.S. Appl. No. 13/909,433) dated Dec. 8, 2014.
Notice of Allowance on co-pending (U.S. Appl. No. 13/909,433) dated Apr. 28, 2015.
Office Action on co-pending (U.S. Appl. No. 14/027,916) dated May 11, 2015.
Non-Final Office Action on co-pending (U.S. Appl. No. 14/809,019) dated Sep. 14, 2015.
Notice of Allowance on co-pending (U.S. Appl. No. 14/027,972) dated Oct. 7, 2015.
Final Office Action on co-pending (U.S. Appl. No. 14/027,916) dated Dec. 2, 2015.
Notice of Allowance on co-pending (U.S. Appl. No. 14/809,019) dated Mar. 17, 2016.
Notice of Allowance on co-pending (U.S. Appl. No. 14/027,916) dated Jun. 23, 2016.
Office Action on corresponding foreign application (CA Application No. 2821533) from the Canadian Intellectual Property Office dated Feb. 1, 2017.
International Search Report on corresponding PCT application (PCT/CN2014/085987) from International Searching Authority (SIPO) dated May 28, 2015.
Written Opinion on corresponding PCT application (PCT/CN2014/085987) from International Searching Authority (SIPO) dated May 28, 2015.
International Search Report on corresponding PCT application (PCT/CN2014/086039) from International Searching Authority (SIPO) dated Jun. 4, 2015.
Written Opinion on corresponding PCT application (PCT/CN2014/086039) from International Searching Authority (SIPO) dated Jun. 4, 2015.

* cited by examiner

HANDLE SET HAVING LATCH BOLT ACTUABLE BY PUSHING HANDLE

CROSS-REFERENCE TO RELATED APPLICATIONS

This application is the national phase entry, under 35 U.S.C. Section 371(c), of International Application No. PCT/CN2014/086038, filed Sep. 5, 2014. The disclosure of the International Application from which this application claims priority is incorporated herein by reference in its entirety.

FEDERALLY SPONSORED RESEARCH OR DEVELOPMENT

Not Applicable

BACKGROUND

The present disclosure relates to the field of handle sets for doors.

The term lockset is used to refer to the hardware and components for locking and/or latching doors. Handle sets refer to locksets having an elongated handle attached to at least one side of the door. Handle sets have been available for years in which an elongated handle has a button disposed on or adjacent the handle, which button can be operated to actuate a latch bolt. Such handle sets are particularly popular for use in front entry doors of residences.

In a typical front entry door handle set, the elongated handle is elongated, and mounts to the outer side 44 of the door via two spaced-apart holes. The handle itself typically remains stationary relative to the door. The button is typically positioned so as to be actuable by the user's thumb. The button interacts with the lockset portion of the handle set so as to withdraw the latch bolt when the button is pressed by the user. However, often such buttons can be difficult or inconvenient to actuate. Usually a knob is disposed on the indoor side of the door. Such a knob is typically configured to work in a traditional manner so as to withdraw the latch bolt when the knob is rotated.

Recently, locksets have been developed in which the latch bolt is actuated not only by rotation of one or both of a pair of traditional door knobs, but also upon pushing or pulling a knob. Such locksets have greatly increased versatility and ease of use for users. However, since handles such as those used in front entry door handle sets are typically mounted to the door via spaced apart holes, these handles typically are not rotatable, and are not amenable to advanced lockset designs.

A longstanding problem when replacing handle sets that include handles that are mounted to the door via spaced apart holes is that sometimes such holes are not spaced a correct standard distance from one another. Therefore a user may find it difficult to find a handle set that will fit into his door's existing holes. This is a cause of significant frustration among homeowners who would like to replace their existing handle sets.

Another consideration comes concerns reliability and smooth operation. Consumers reasonably expect handle sets and other locksets to withstand the rigors of repeated use over time while operating smoothly and minimizing mechanical noise.

SUMMARY

There is a need in the art for a handle set in which the latch bolt can be actuated by pulling or turning a knob on an indoor side of a door or by pushing on a handle on the outer side of the door.

There is also a need in the art for a handle set that can be used to replace a previous handle set in which the door upon which the handle set is to be mounted may have a nonstandard spacing between mount holes.

There is a further need in the art for a handle set having a handle that actuates retraction of the latch bolt when pushed, and which pivots when pushed by the user, and in which a connection of the handle to the lockset ensures smooth and reliable performance over time.

There is a still further in need in the art for a latch bolt assembly that facilitates ease of use and low friction even when the latch bolt is pushed up against the corresponding door's strike plate during actuation.

In accordance with one embodiment, a handle set is provided. The handle set comprises a retractor assembly configured to be fit within a door mount hole and configured to be operably coupled to a latch bolt assembly and to selectively retract a latch bolt of the latch bolt assembly when a retractor of the retractor assembly is urged in an actuating direction. First and second elongated spindles extend through the retractor assembly, and are axially connected to one another such that the first and second spindles move axially together as a unit. The second spindle can be rotatable relative to the first spindle. The first and second elongated spindles can define a first actuator surface and a second actuator surface, and can move axially in a first direction. The first actuator surface can be placed into engagement with the retractor of the retractor assembly so as to urge the retractor in the actuating direction. When the second spindle is rotated relative to the first spindle, the second actuator surface can be placed into engagement with the retractor of the retractor assembly so as to urge the retractor in the actuating direction.

In another embodiment, the first actuator surface can be formed on the first elongated spindle and the second actuator surface formed on the second elongated spindle.

In yet another embodiment, the first elongated spindle can be connected to a first mounting tab of an elongated handle, the elongated handle can have a second mounting tab configured to be pivotably connectable to a door, and the first mounting tab can define a slot therein oriented in a direction to accommodate a distance between the second mounting tab and axes of the first and second elongated spindles.

In one embodiments, the second elongated spindle is rigidly connectable to a knob. In another embodiment, the first and second actuator surfaces can both be formed on one of the first and second elongated spindles. In other embodiments, one of the first and second spindles comprises a hollow distal end and the other of the first and second spindles comprises an overlap portion sized to extend into and be supported within the hollow distal end.

In one embodiment, the overlap portion can comprise a fastener receiver formed in a wall thereof, and the hollow distal end can have an elongated slot formed through a wall thereof about a portion of its circumference.

In other embodiments, when the overlap portion is disposed within the hollow distal end, the fastener receiver is aligned with the slot, and a spindle bolt is disposed within the fastener receiver so that a head of the spindle bolt is disposed within the slot and is raised from a surface of the overlap portion.

In one embodiments, the head of the spindle bolt is axially aligned with an edge of the slot so that if the hollow distal end is moved axially the slot edge will be blocked from moving past the spindle bolt. In another embodiment, the first and second spindles are rotatable relative one another over a range of rotation, and the spindle bolt remains within the slot during such rotation. In still other embodiments, the range of rotation is defined by opposing ends of the slot.

In other embodiments, the first actuator surface can comprise an inclined cam surface, and the second actuator surface can comprise an axially-directed surface that is configured to move in the actuating direction when the second spindle is rotated relative to the first spindle.

Other embodiments can additionally comprise an elongated handle having spaced apart first and second mounting tabs. The first mounting tab is connected to the first spindle, and the second mounting tab is pivotably connectable to a door. In another embodiment, the first mounting tab comprises an elongated slot, and the first spindle can be attached to the first mounting tab at any point along a length of the elongated slot.

In accordance with another embodiment, a lockset is provided, comprising a retractor assembly configured to be fit within a door mount hole and configured to be operably coupled to a latch bolt assembly and to selectively retract a latch bolt of the latch bolt assembly when a retractor of the retractor assembly is urged in an actuating direction. An elongated spindle extends through the retractor assembly and define an inclined cam surface. The lockset can further comprise an elongated handle having first and second spaced apart mounting tabs. The second mounting tab is pivotably mountable on an inwardly-opening door, and the first mounting tab is mountable to an end of the elongated spindle. When the handle is pushed so that it pivots about the second mounting tab, the first mounting tab moves in a generally axial direction so that the elongated spindle also moves in the generally axial direction. When the spindle moves in the generally axial direction, the inclined cam surface engages the retractor of the retractor assembly and urges the retractor in the actuating direction so as to retract the latch bolt.

In other embodiments, the first mounting tab comprises an elongated slot, and the spindle is attached to the first mounting tab at a point along the elongated slot. The elongated slot extends in a direction transverse an axis of the spindle. The spindle can comprise an elongated channel configured to receive the first mounting tab, a first hole formed through the spindle on a first side of the channel, and a second hole formed at least partially through the spindle on a second side of the channel and aligned with the first hole. The second hole is threaded and has a diameter smaller than a diameter of the first hole. An elongated hollow bushing extends through the first hole, the elongated slot of the first mounting tab, and engaging the second side of the channel. An elastomeric O-ring abuts an end of the hollow bushing, a bolt extends through the bushing and threadingly engages with the second hole, and a head of the bolt urges the O-ring into engagement with the end of the bushing, wherein the bushing, O-ring, and bolt are all inserted through the first hole.

DETAILED DESCRIPTION

Figure 1:
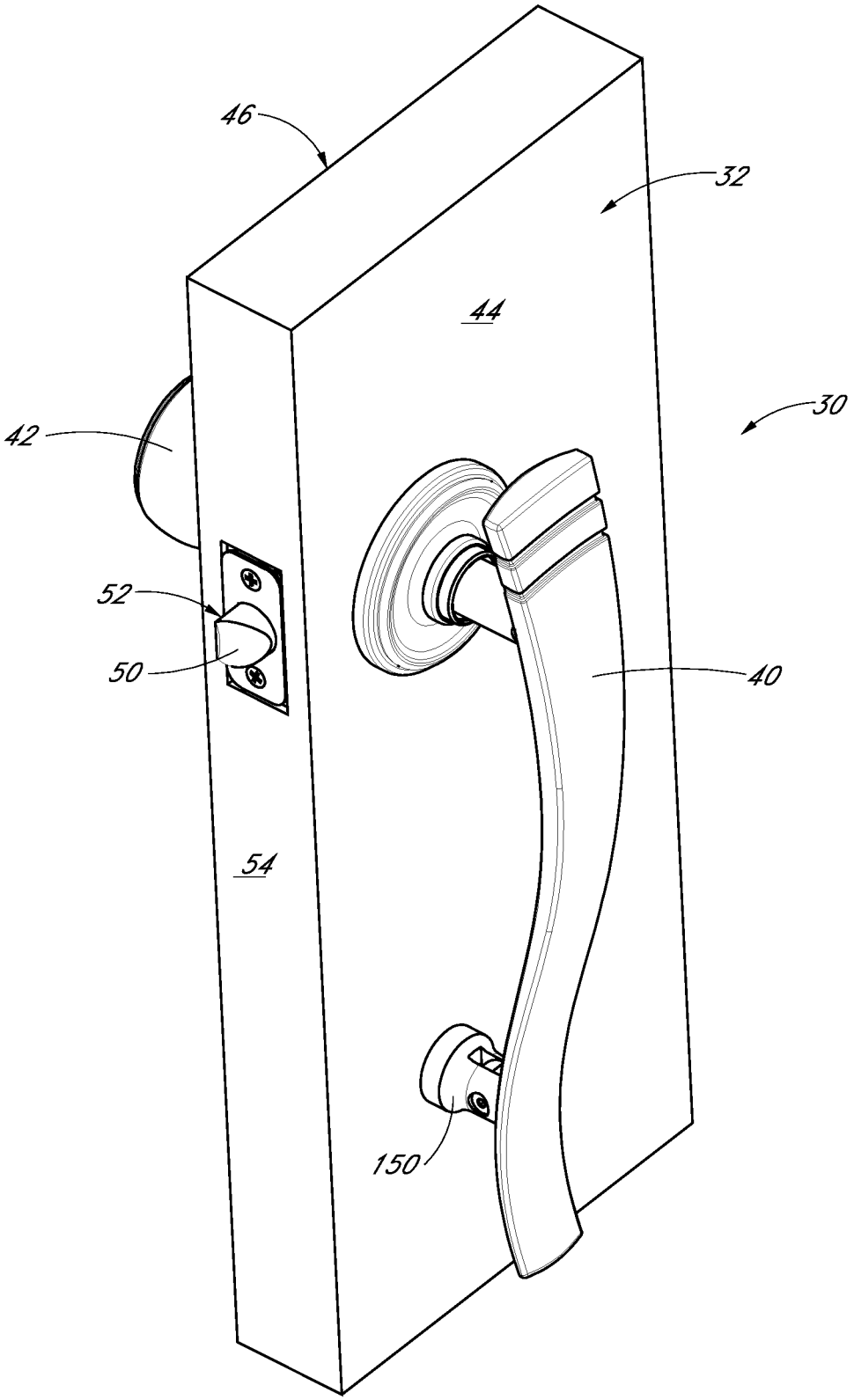
FIG. 1 is a perspective view of a handle set in accordance with one embodiment mounted to a door so that the door is configured to swing inwardly.
Figure 4:
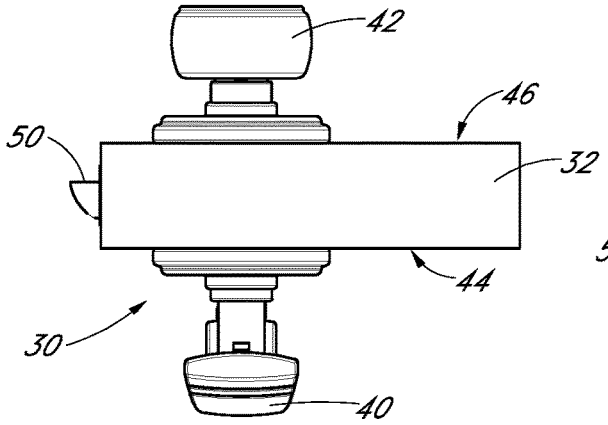
FIG. 4 shows the handle set of FIG. 1 viewed from a top edge of the door.
Figure 3A:
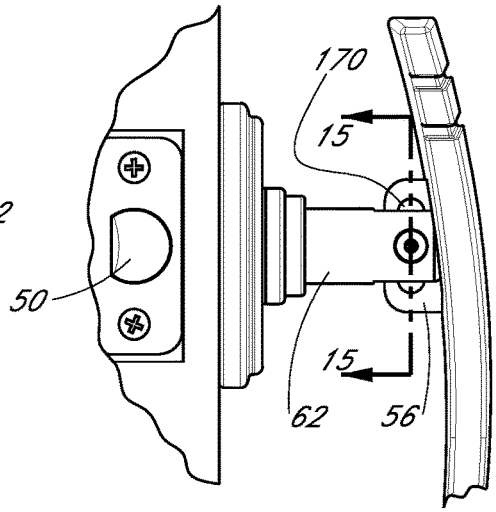
FIG. 3A is a close up view taken along lines 3A-3A of FIG. 3.
Figure 2:
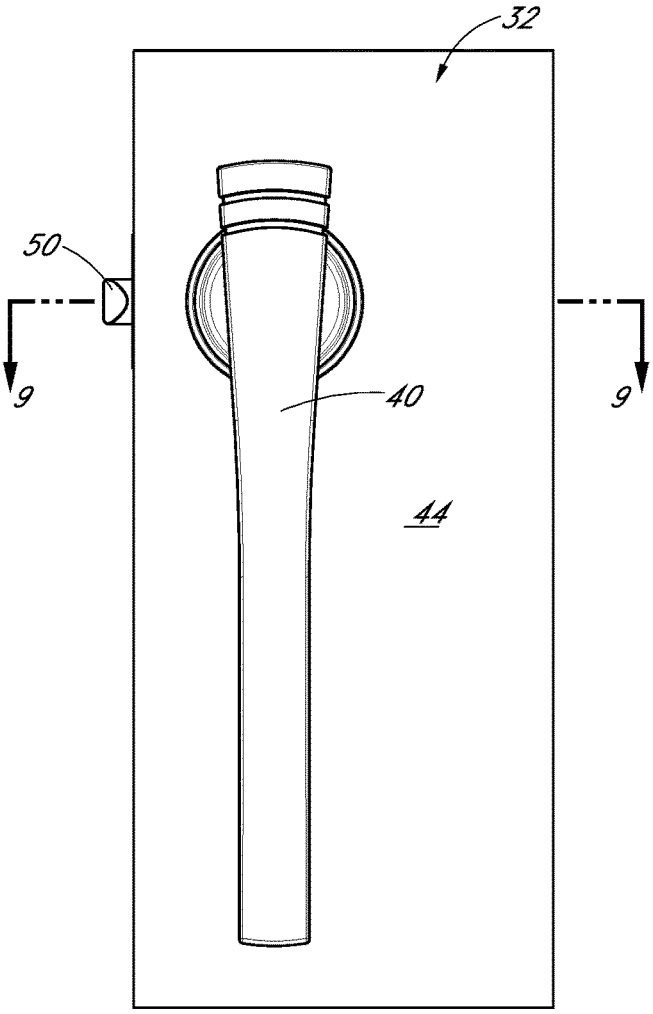
FIG. 2 shows the handle set of FIG. 1 viewed from an outer side of the door.

FIG. 1 shows a perspective view of a handle set 30, in accordance with a preferred embodiment of the present disclosure, installed on a door 32. With additional reference to FIGS. 2-4, the illustrated handle set 30 has an elongated outside handle 40 and an inside knob 42. The outside handle 40 is installed on an outer side 44 of the door 32, and the inside knob 42 is disposed on an inner side 46 of the door 32. Preferably the outside handle 40 and the inside knob 42 can each be actuated to selectively retract a latch bolt 50 of a latch bolt assembly 52 that is mounted on a latch side edge 54 of the door 32. The illustrated door 32 is configured to open inwardly as a typical front entry door.

The illustrated outside handle 40 is elongated and has a one-piece construction. First and second mounting tabs or upper and lower spaced apart handle mounting tabs 56, 58 extend from an inner surface of the outside handle 40. Notably, the illustrated handle set 30 does not have a button-type actuator on the outside 44 of the door 32. Instead, and as will be discussed in more detail below, pushing on the outside handle 40 at a point above the lower handle mounting tab 58 causes the latch bolt 50 to be retracted so as to enable opening of the door 32.

Figure 5:
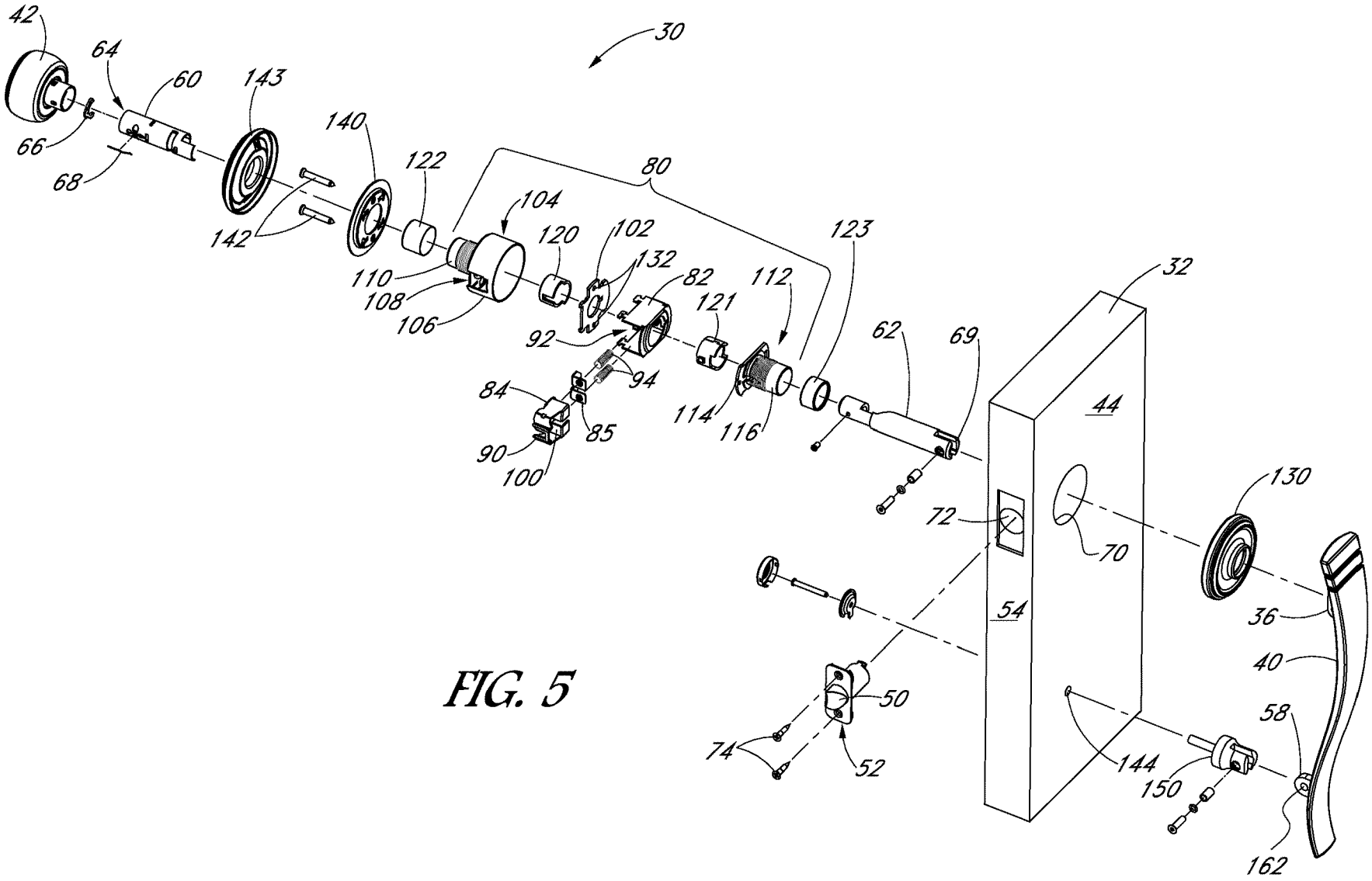
FIG. 5 is an exploded view of the handle set and door of FIG. 1.

With reference next to FIG. 5, an exploded view of one embodiment of the handle set 30 is shown. The illustrated handle set comprises an axial spindle made up of an inner spindle 60 and an outer spindle 62. The inner spindle 60 has a proximal end 64 configured to engage the inside knob 42 so that the inner spindle 60 moves with the inside knob 42. A connector 66 and connector spring 68 help to releasably attach the inside knob 42 to the inner spindle 60. With additional reference to FIG. 6, a proximal end 69 of the outer spindle 62 comprises a mount channel 172 that is configured to receive the upper handle mounting tab 56 so as to connect the outer spindle 62 to the outside handle 40.

The inner and outer spindles 60, 62 are aligned with and extend at least partially through a primary mount hole 70 formed through the door 32. The latch assembly 52 comprising the latch bolt 50 is fit into a latch hole 72 formed in the latch side edge 54 of the door. The latch hole 72 preferably communicates with the primary mount hole 70. The latch assembly 52 can be secured in place with screws 74.

A retractor assembly 80 comprises several components that cooperate to engage the latch assembly 52 and retract the latch bolt 50 when actuated. A guide frame 82 receives a retracting piece 84 so that a latch engagement portion 90 of the retracting piece 84 extends through an open end 92 of the guide frame 82. Springs 94 aligned with spring guides are interposed between a retractor engagement surface 100 of the retracting piece 84 and a closed back of the guide frame 82. A guide frame side plate 102 is joined to the guide frame 82. The guide frame side plate 102 preferably is rigidly attached to the guide frame. A spring plate 85 can also be positioned between the springs 94 and the retracting piece 84 to keep the springs 94 in place. The spring plate 85 can be L-shaped.

A retractor housing 104 has a hub portion 106 that generally encloses the guide frame 82. However the latch engagement portion 90 of the retracting piece 84 remains accessible through an aperture 108 of the hub portion 106, and an elongated tubular body 110 of the retractor housing 104 extends in a direction away from the guide frame 82. In a preferred embodiment at least a portion of the elongated tubular body 110 of the retractor housing is threaded.

A cover plate mount 112 is disposed on a side of the guide frame opposite the retractor housing 104 and has a flange 114 that engages and is attached to the guide frame 82. An elongated tubular body 116 extends from the flange 114 and is threaded along at least a portion of its outer surface. In one embodiment, the elongated tubular body 116 has a small shoulder that connects directly to the flange 114. A locking sleeve 121 can be used to fix the elongated tubular body 116 to the flange 114.

The components of the retractor assembly 80 preferably include axial apertures so that the spindles 60, 62 can extend therethrough. An inside spindle bushing 120 and the locking sleeve 121 can help support the spindles 60, 62 extending through the retractor assembly 80. The inside spindle bushing 120 can act as guide bushing for the inside spindle 60. An inside finishing ring 122 can be press fit onto the end portion of the retractor housing 104 at or on the elongated tubular body 110 to provide a cosmetic finished surface to the inner side 46 of the handle set 30. An outside finishing ring 123 can be press fit over the end portion of the elongated tubular body 116 to provide a stop surface for the range of threaded adjustment for the outside rose 130 and to provide a finished cosmetic surface to the outside handle set 30.

An outside rose and/or cover plate 130 is disposed on the outer side 44 of the door 32. The illustrated rose 130 has an internal aperture that is threaded and configured to engage the outer threads of the elongated tubular body 116. The guide frame plate 102 preferably has a pair of mount bolt receivers 132. An inside mount plate 140 is configured to abut the inner side 46 of the door 32 and has apertures that can be aligned with the guide frame plate mount bolt receivers 132. A pair of mount bolts, such as machine screws 142, can be advanced through the apertures and into the receivers 132 to tighten the mount plate 140 against the inner side 46 of the door so that the door 32 is sandwiched between the inside mount plate 140 and the outside cover plate 130, with the retractor assembly 80 disposed within the primary mount hole 70, and the latch engagement portion 90 of the retracting piece 84 engaged with the latch assembly 52. An inside rose 143 cover plate can be fit over the inside mount plate 140 or thread onto a threaded portion of the elongated tubular body 110.

A secondary hole 144 is formed through the door 32 preferably vertically below and spaced from the primary mount hole 70. A handle pivot mount 150 preferably has a mount channel 152 configured to receive the lower handle mounting tab 58. An elongate, internally threaded receiver 154 is sized to fit into the secondary hole 144. A handle machine screw 156 fits through a washer 158 and into the secondary hole 144 so as to engage and threadingly connect to the elongated receiver 154 so as to firmly attach the washer 158 and handle pivot mount 150 to the door. A screw cover 160 can be attached to the washer 158 as a decorative piece to hide the washer and the screw.

Figure 3:
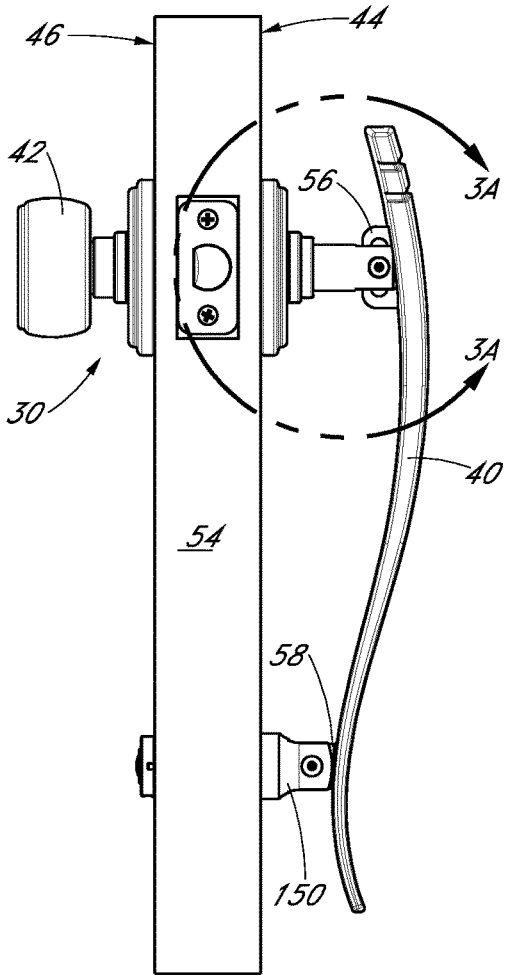
FIG. 3 shows the handle set of FIG. 1 viewed from a latch side edge of the door.
Figure 6:
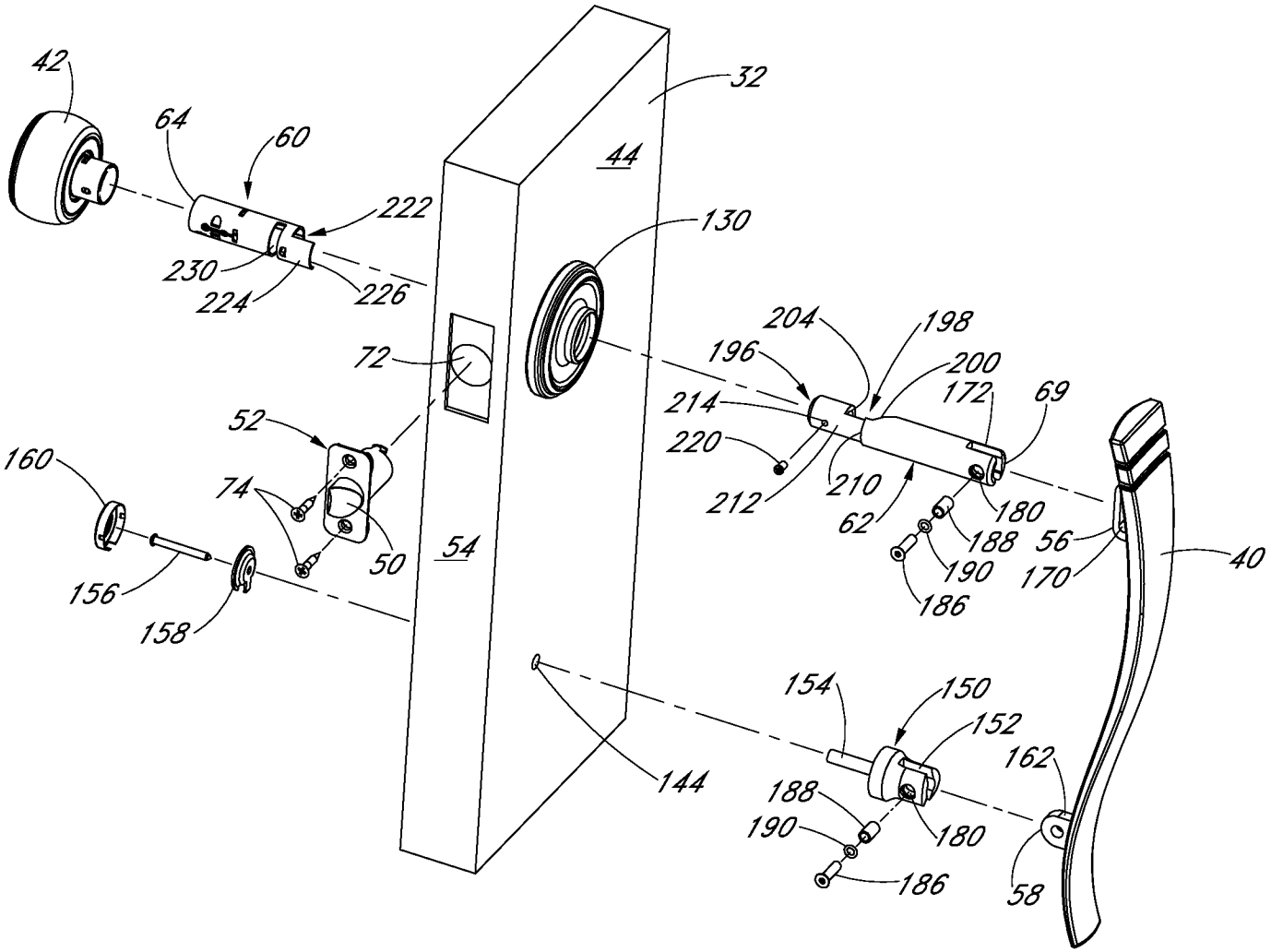
FIG. 6 is a partially exploded view of the handle set and door of FIG. 1, showing selected components for discussion.

With continued reference to FIG. 6 and additional reference to FIGS. 3 and 7, the upper and lower handle mounting tabs 56, 58 are spaced apart from one another and raised from an inner surface of the outside handle 40. In the illustrated embodiment, the lower handle mounting tab 58 includes a circular aperture 162, and the upper handle mounting tab 56 is elongated and includes an elongated slot 170. In the illustrated embodiment, the elongated slot 170 is substantially straight. It is to be understood that, in other embodiments, the elongated slot can be arcuate.

Figure 15:
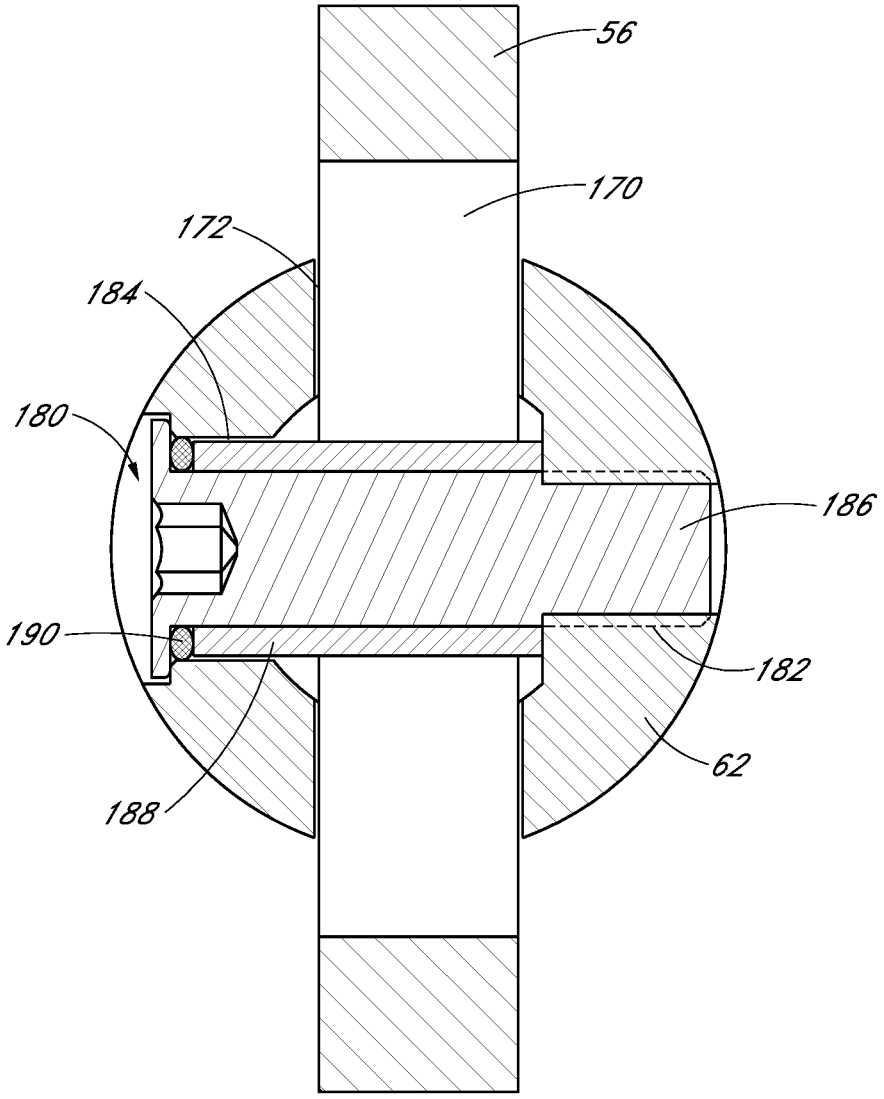
FIG. 15 is a cross sectional view taken along line 15-15 of the arrangement of FIG. 3A.

A width of the upper handle mounting tab 56 is selected so that the upper handle mounting tab 56 slides readily into a mount channel 172 at the proximal end of the outer spindle 62. With additional reference to FIG. 15, a mount aperture 180 extends transversely through the outer spindle 62 so as to traverse the mount channel 172. The mount aperture 180 includes a threaded boss aperture 182 on one side of the channel 172 and a counter sunk aperture 184 having a diameter greater than the threaded boss aperture 182 on the other side of the channel 172. A pivot bolt 186 has an elongated body, a threaded distal end, and a flanged head. A bushing 188 fits through the counter sunk aperture 184 and through the elongated slot 170 of the upper handle mounting tab 56, but has a diameter too great to fit through the threaded boss aperture 182.

An elastomeric O-ring 190 such as a rubber or silicone O-ring sits atop the bushing 188 in the counter sunk aperture 184. The pivot bolt 186 is advanced through the O-ring 190 and bushing 188 so that its threaded distal end engages and is threaded onto the threaded boss aperture 182. Preferably the pivot bolt 186 is tightened sufficiently so that its flanged head compresses the O-ring 190 and communicates force to the bushing 188. This configuration generates a high friction force between the O-ring 190 and the head of the pivot bolt 186, which friction force hinders the pivot bolt 186 from loosening over time due to weathering and/or vibrations during use of the handle set 30.

In the illustrated embodiment, the bushing 188 is a nonmetal bushing having a low-friction surface so as to enable the inner surface of the elongated slot 170 to slide readily over the bushing surface. Also, in some embodiments the bushing can be configured to rotate about the pivot bolt 186, particularly if friction arises between slot surfaces and the bushing outer surface. Also, as demonstrated in FIGS. 3, 5 and 15, each component of the fastener structure for securing the upper handle mounting tab 56 to the spindle 62 is inserted through the same side of the mount aperture 180.

In the illustrated embodiment, the handle pivot mount 150 has a similar mount channel 152 and mount aperture 180 structure as does the outer spindle 62, and can employ similar fastening structures. The lower handle mounting tab 58 preferably fits within the pivot mount channel 152, and the bushing 188 and pivot bolt 186 extend through the mount aperture 180 and tab aperture 162 to secure the lower handle mounting tab 58 to the pivot mount 150. As in the embodiment above, the bushing preferably has a low-friction outer surface that functions as a bearing surface so that the lower handle mounting tab can rotate over the bushing surface. As such, the outside handle 40 can pivot about the lower handle mount 58.

It is a standard practice in the industry to provide a distance of 8⅜ inches between the primary mount hole 70 and the secondary mount hole 144 for mounting handle sets in front entry doors. However in practice some designs vary from this standard distance, and sometimes door holes have been improperly prepared. In the illustrated embodiment, the elongated slot 170 can extend for a distance up to, for example, 1 inch or, in another embodiment, up to about ⅝ inch. The fasteners that secure the upper handle mounting tab 56 to the outer spindle 62 can be attached to the upper handle mounting tab 56 anywhere along the length of the elongated slot 170. As such, the illustrated outside handle 40 can be suitably installed on doors having non-standard distances between the primary mount hole and the secondary mount hole.

In the illustrated embodiment, the vertical position of the lower handle mounting tab 58 is fixed, as the lower handle mounting tab 58 has a circular aperture 162 configured to rotate about the bushing 188. However due to the elongated slot 170 of the upper mounting tab 56, the position of the outside handle 40 relative to the primary mount hole 70 and the retractor assembly 80 within the primary mount hole 70 is versatile and does not need to be precise.

Other embodiments may employ this principle in other ways. For example in another embodiment, both the upper and lower handle mounting tabs 56, 58 may include elongated slots. As such, the vertical position of the handle can be selectively adjusted by the installer. In still another embodiment, the upper handle mounting tab 58 may include a circular aperture while the lower mount may include an elongated slot. In still other embodiments, neither the upper nor lower handle mounting tabs 56, 58 may include an elongated slot, but may include circular apertures so that the handle may only be mounted on doors having a prescribed distance between the primary mount hole and secondary mount hole.

With particular reference next to FIGS. 6-8, the outer spindle 62 has a distal end 196 opposite its proximal end 69. A cavity 198 is disposed between the proximal and distal ends. An inclined cam surface 200 extends from an outer surface of the spindle 62 into the cavity 198 and to a cavity surface 202. An offset surface 204 is spaced from the cam surface 200 and extends from the cavity surface 202 to the outer surface of the outer spindle 62. The outer spindle also includes an inwardly-directed offset 210 between the proximal 69 and distal ends 196. A reduced diameter portion 212 of the spindle 62 is defined distal of the offset 210. An internally threaded receiver aperture 214 is formed through the wall of the outer spindle 62 in the reduced diameter portion 212, and is configured to receive a threaded spindle bolt 220 therein. As noted above, the outer spindle 62 is connected to and moves with the outside handle 40.

With continued reference to FIGS. 6-8, the inner spindle 60 comprises a hollow tube that has a distal end 222 opposite its proximal end 64. An actuator portion 224 of the inner spindle 60 extends distally from the distal end 222, terminating in an actuator distal surface 226. Opposing edges of the actuator define actuator surfaces 228. An arcuate slot 230 is defined through the wall of the spindle 60 and extends about a portion of the circumference of the inner spindle 60. In the illustrated embodiment, the arcuate slot 230 extends between about 90-180° about an axis of the inner spindle 60. Further, in the illustrated embodiment, each of the opposing edges of the slot 230 lies in a plane perpendicular to the spindle axis.

Figure 7B:
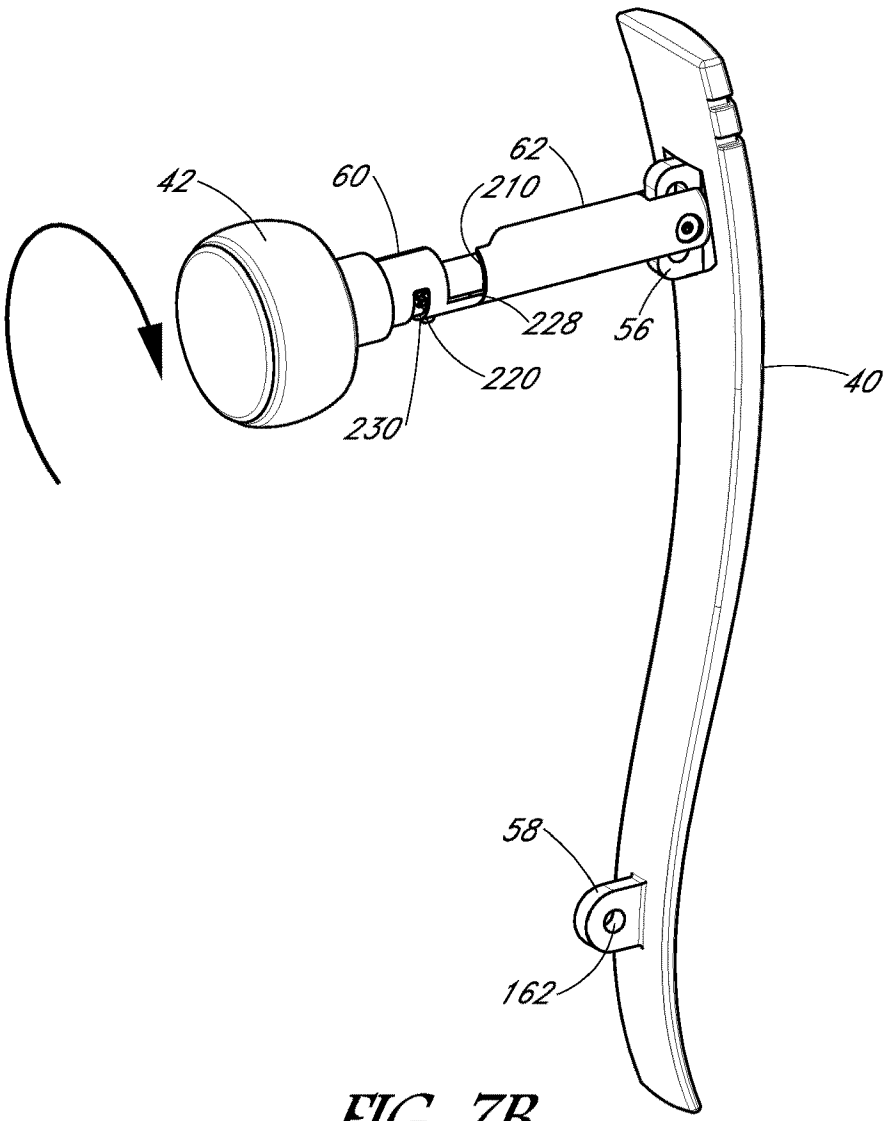
FIG. 7B shows the arrangement of FIG. 7A with the knob rotated.
Figure 7A:
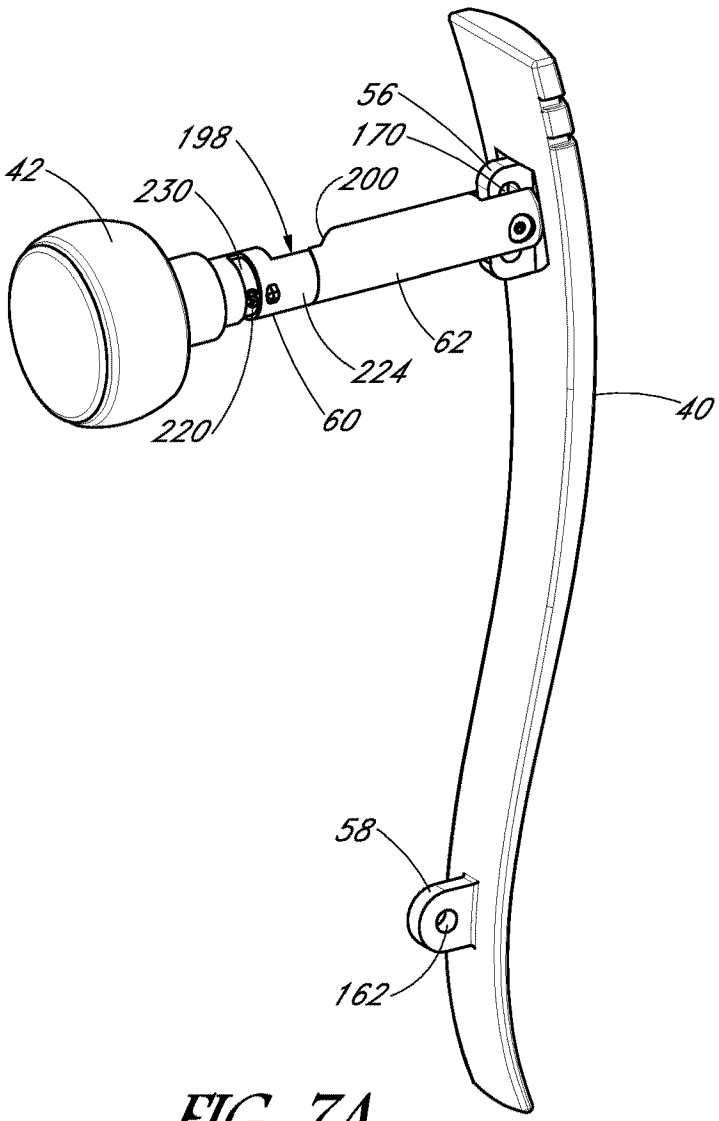
FIG. 7A is a perspective view showing a handle, knob and spindle in accordance with one embodiment and in an at rest position.

As shown in FIG. 6, the inner and outer spindles 60, 62 are axially aligned with one another. With particular reference to FIGS. 7 and 8, the reduced diameter portion 212 of the outer spindle 62 fits within the tubular inner spindle 60. As shown with particularity in FIG. 7A, the inner and outer spindles fit together so that the actuator distal surface 226 of the inner spindle 60 generally abuts the offset 210 of the outer spindle 62. Preferably the offset generally approximates the width of the inner spindle wall.

When the inner and outer spindles are aligned as shown in FIG. 7A, the threaded receiver 214 formed in the reduced diameter portion of the outside spindle is aligned with the arcuate slot 230 of the inside spindle, and preferably the spindle bolt 220 is advanced through the slot 230 and threaded into the receiver 214.

The head of the spindle bolt 220 preferably is sized to fit between opposing edges of the inner spindle slot 230, and is also raised from the surface of the reduced diameter portion 212 when installed. As such, with the spindle bolt 220 in place, the opposing edges of the slot 230 will engage the spindle bolt head to block the inner spindle 60 from sliding axially over the outer spindle 62. As such, the inside and outside spindles will move axially together as one spindle. However, as shown particularly in FIG. 7B, the inner spindle 60 can rotate relative to the outer spindle over a limited range of rotation defined between the rotational locations at which the spindle bolt head engages opposing ends of the arcuate slot 230. As such, the inside knob 42 can be rotated relative to the outside handle 40.

Figure 8A:
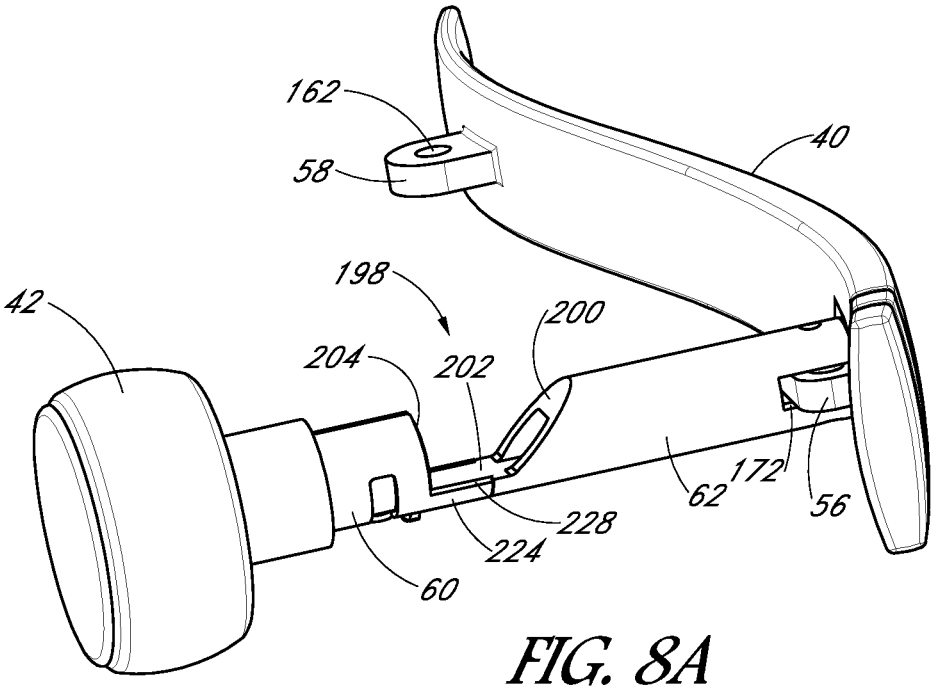
FIGS. 8A and 8B each show another perspective view of the arrangements as shown in FIGS. 7A and 7B, respectively.
Figure 8B:
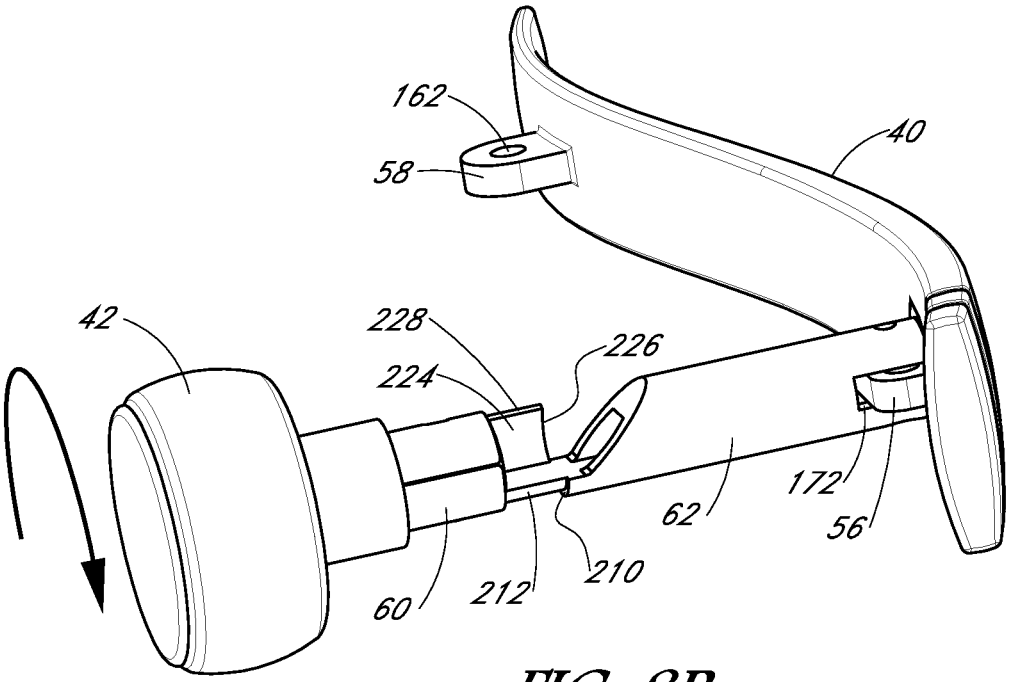

In an at-rest position as depicted in FIGS. 7A and 8A, the actuator surfaces 228 are substantially aligned with the cavity surface 202 of the outside spindle. However, when the inside knob 42 is rotated as depicted in FIGS. 7B and 8B, one of the actuator surfaces 228 rises from the cavity surface 202, and the offset 210 and a portion of the reduced diameter portion 212 of the outside spindle 62 are exposed. It is to be understood that, if the knob is rotated in an opposite direction, the other one of the actuator surfaces 228 will rise from the cavity surface.

Figure 9:
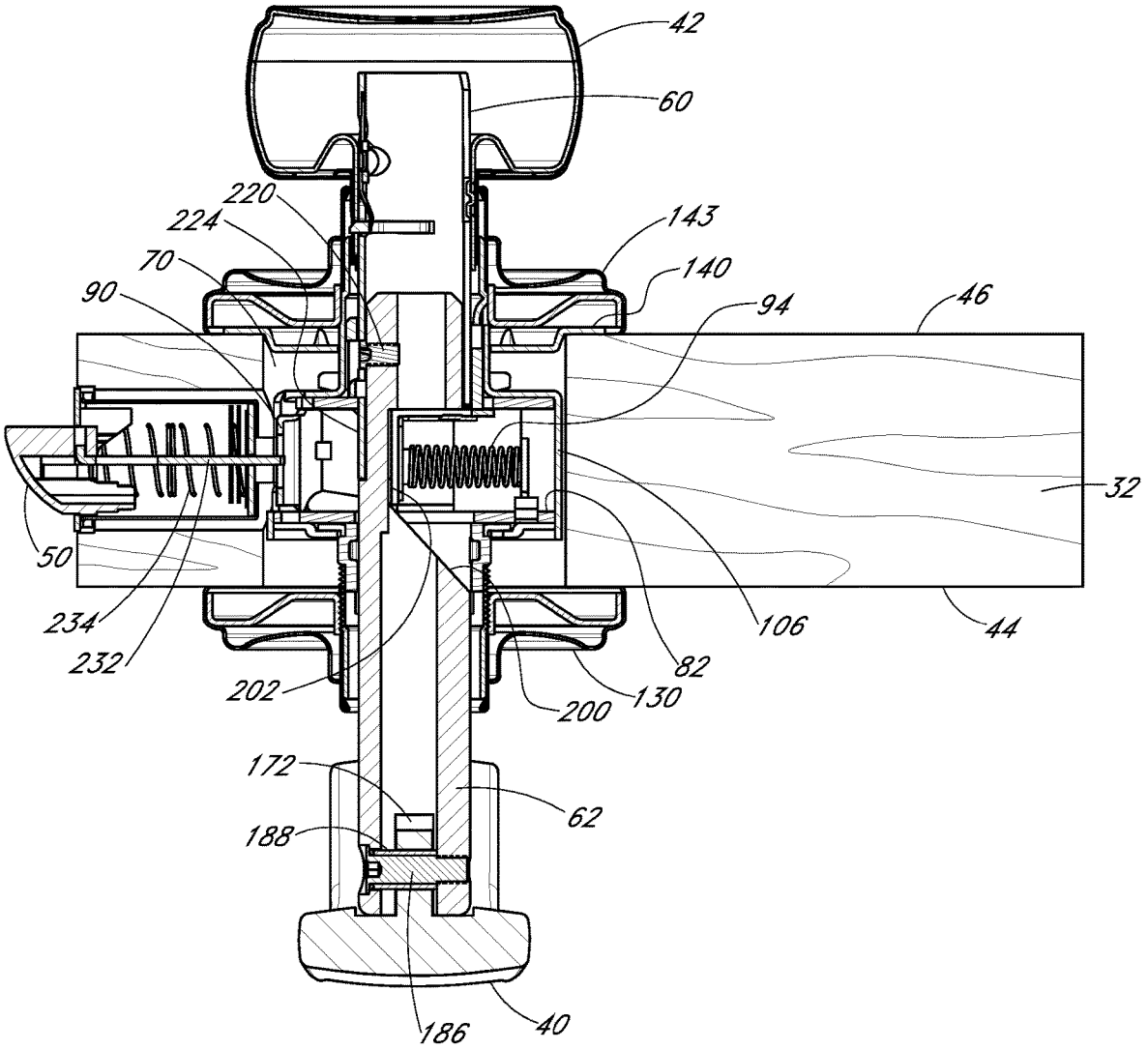
FIG. 9 is a cross sectional view of the arrangement of FIG. 2 taken along lines 9-9.

With reference next to FIGS. 7A, 8A and 9, when the handle set 30 is in an at-rest position such as when the associated door is closed, the inside and outside spindles 60, 62 remain assembled and extend through the retractor assembly. In this arrangement, the latch engagement portion 90 of the retracting piece 84 is engaged with a latch retractor bar 232 that is connected to the latch bolt 50. A latch spring 234 biases the latch bolt 50 outwardly. Similarly, the retractor spring 94 is pushing the retractor engagement surface 100 into contact with the cavity surface 202, which is aligned with the actuator surfaces 228 of the inside spindle.

Figure 10:
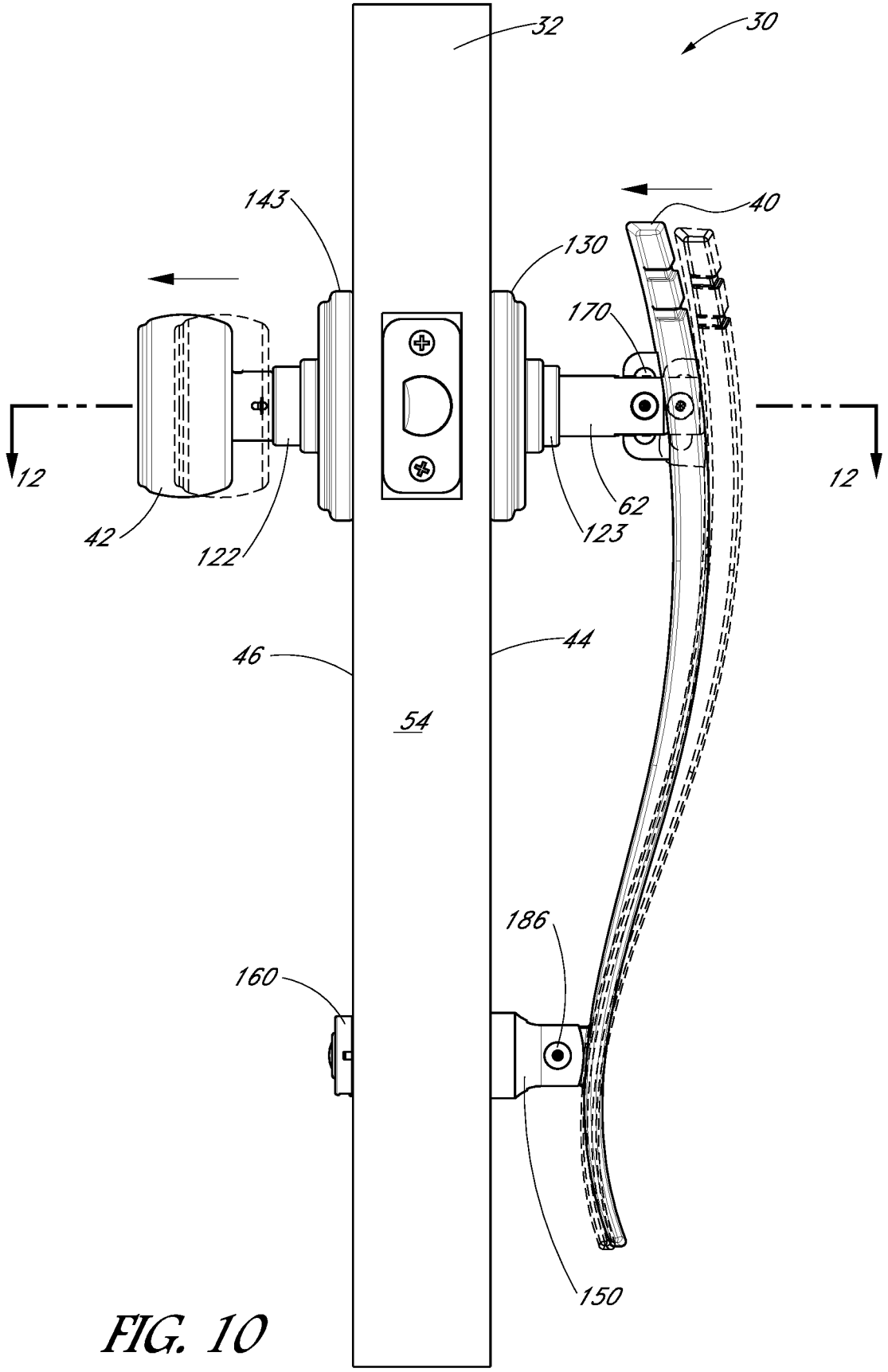
FIG. 10 shows the arrangement as in FIG. 3 in which the handle set has been actuated by pushing the handle or pulling the knob.
Figure 11:
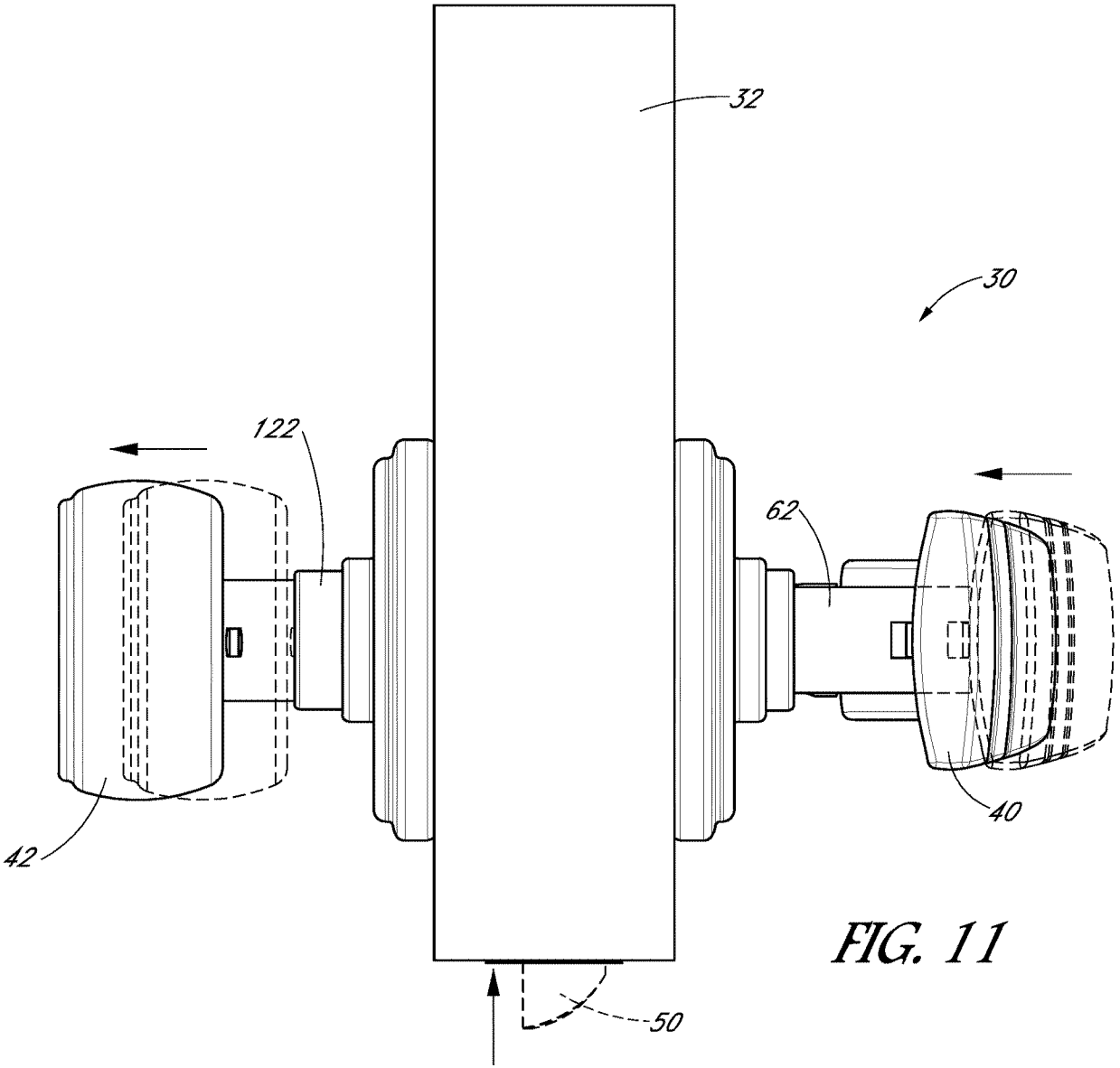
FIG. 11 is a top view of the arrangement of FIG. 10.
Figure 12:
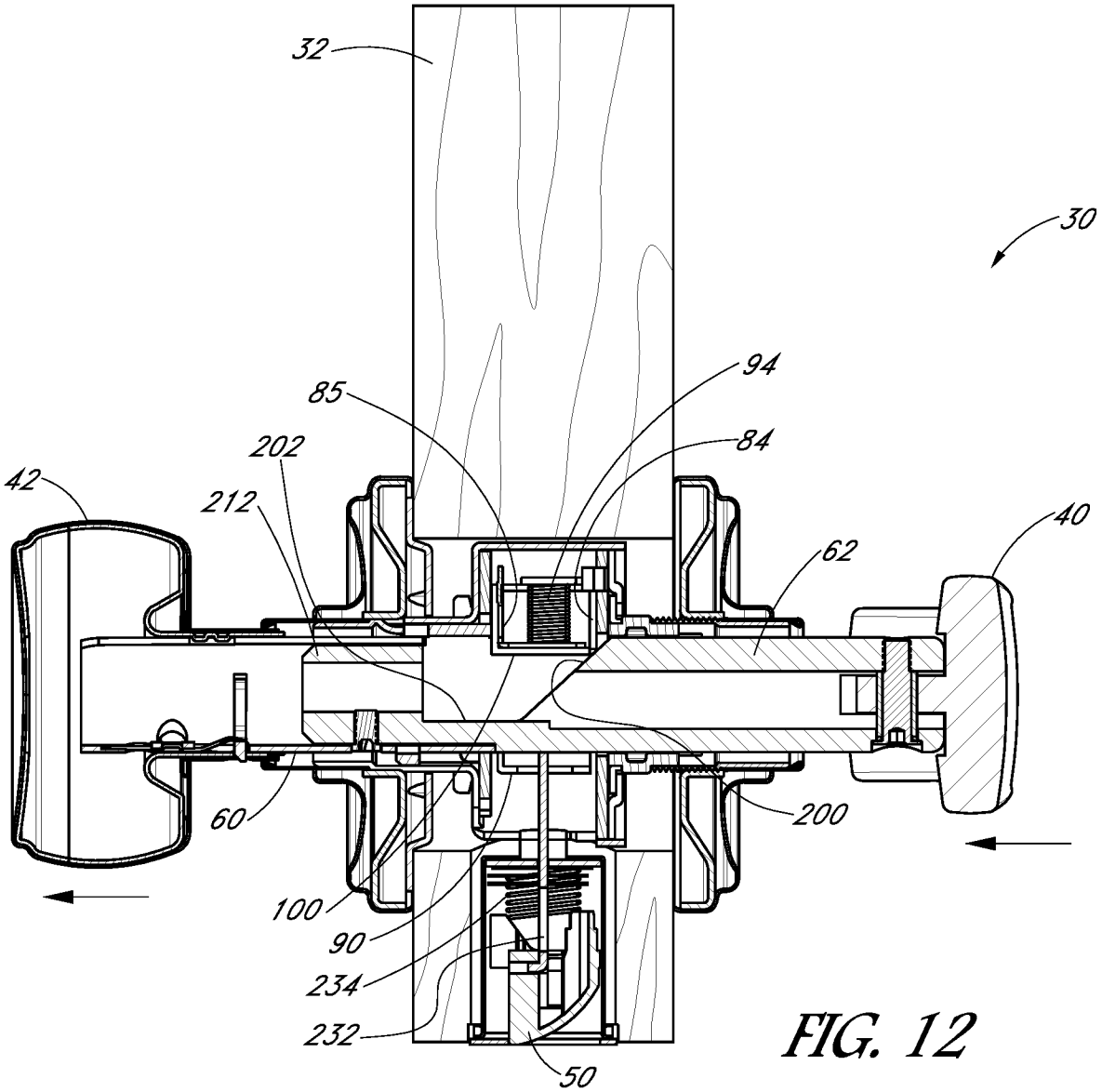
FIG. 12 is a cross-sectional view of the arrangement of FIG. 10 taken along lines 12-12.
Figure 13:
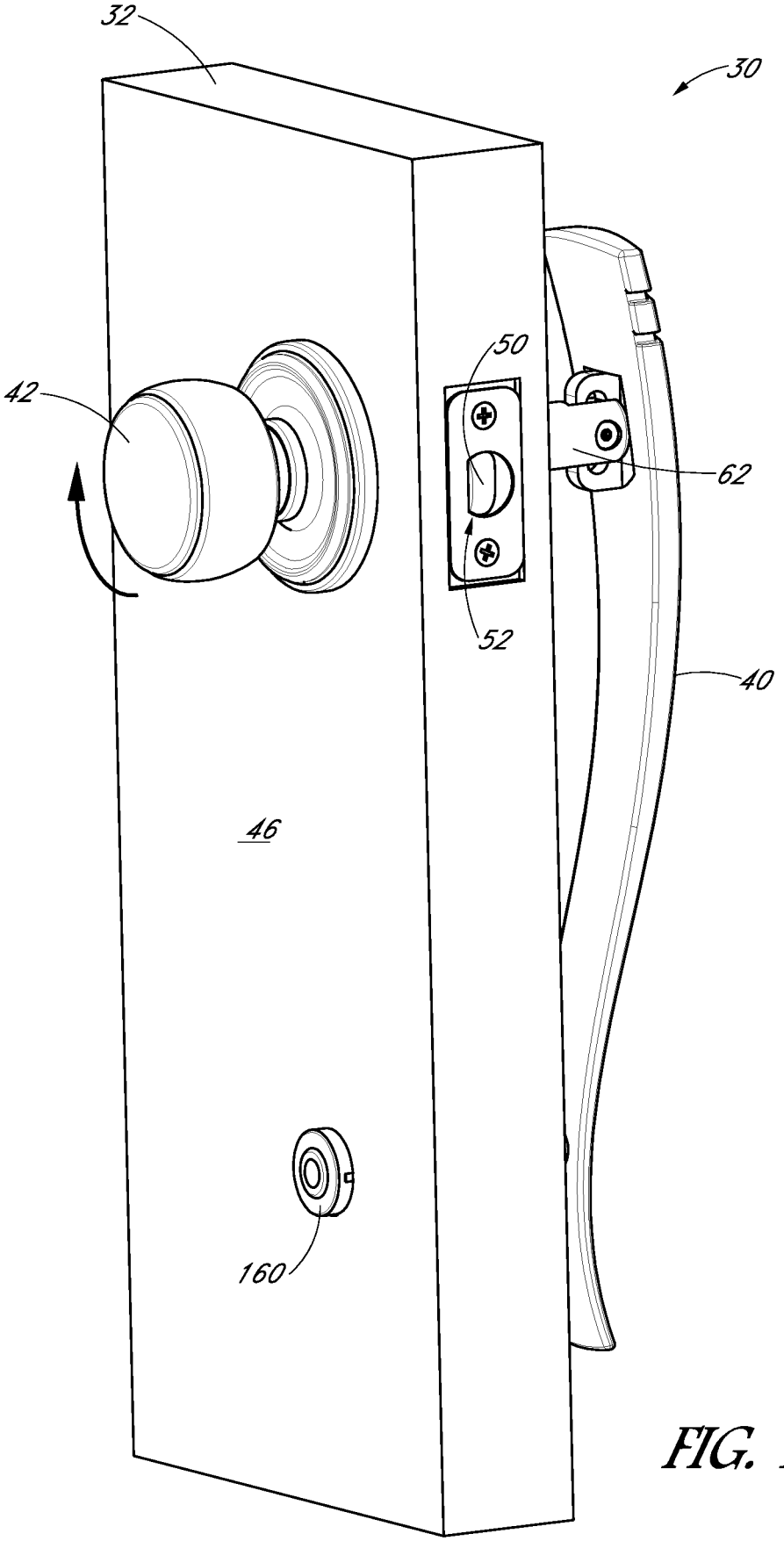
FIG. 13 is another perspective view of the arrangement of FIG. 1 showing the handle set actuated by rotating the knob.
Figure 14:
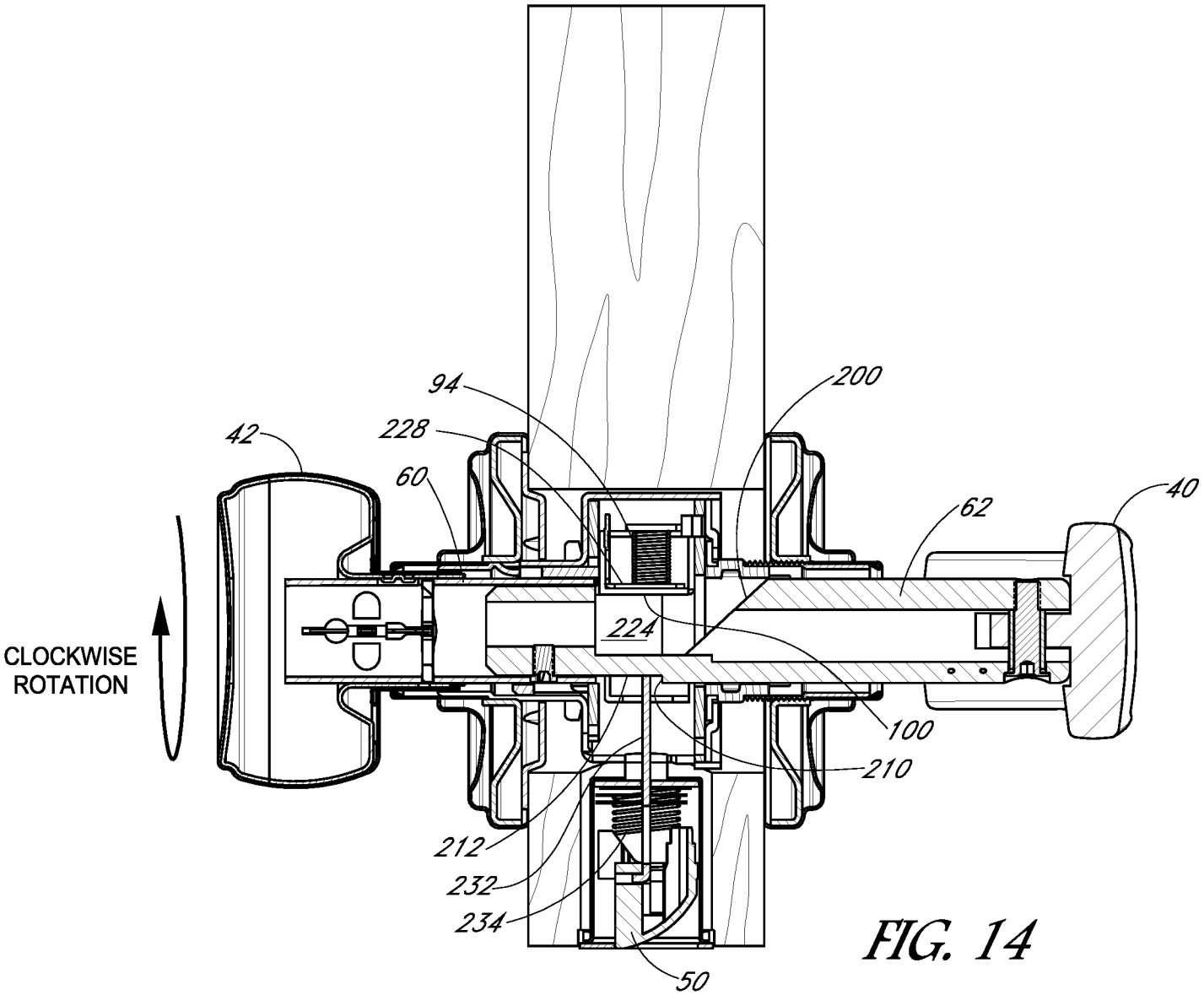
FIG. 14 is a cross-sectional view of the arrangement in FIG. 13.

With reference next to FIGS. 10-12, a user can actuate the handle set 30 by applying a force to either push on the outside handle 40 or pull on the inside knob 42. As discussed above, the handle and knob move axially together whether it is the handle that is pushed or the knob that is pulled. As shown specifically in FIG. 12, when the spindles move axially in an inward direction, the inclined cam surface 200 engages the retractor engagement surface 100 and pushes it inwardly, compressing the retractor spring 94. This action in turn draws the retracting piece 84 and the connected latch retractor rod 232 inwardly, retracting the latch bolt 50 and freeing the door to be opened. When the force pulling on the inside knob 42 or pushing on the outside handle 40 is released, the retractor spring and latch spring urge the handle set back to its at-rest position.

With reference next to FIGS. 7, 8, and 13-14, when the knob is turned, the spindles 60, 62 do not move axially, and in fact the outer spindle 62 does not move. However, the inner spindle 60 rotates, and due to such rotation the actuator surface 228 of the inside spindle rises relative to the cavity surface 202 of the outside spindle. The actuator surface 228 thus engages the retractor engagement surface 100, pushing the retractor inwardly so as to pull the latch retractor rod 232 inwardly and retract the latch bolt 50, freeing the door for opening. This operation is completed without the outside handle 40 moving. Preferably the arcuate slot 230 of the inside spindle is configured to block further rotation at a point at which the actuator surface 228 has pushed the retractor sufficiently inwardly to withdraw the latch bolt.

It is to be understood that various embodiments can employ principles described herein without necessarily using the same structures of the embodiments described specifically herein. For example, in the illustrated embodiment, the outside spindle 62 comprises a cavity 198 defined by a cam surface 200, cavity surface 202, and an offset surface 204, while the inside spindle 60 defines an actuator 224 and side actuator surfaces 228. In another embodiment, the reduced diameter portion of the outside spindle could be much longer than as depicted in the embodiments illustrated in the drawings. For example, the offset marking the beginning of the reduced diameter portion could be positioned proximally of the cam surface. In such an embodiment, the inner spindle defines a cavity and surfaces that substantially align with the cavity and associated surfaces of the outside spindle. As such, the inside spindle surfaces adjacent the cavity surface can function as the actuator surfaces when the knob is rotated.

In yet another embodiment, the outside spindle may be quite short, and the inside spindle may overlap the outside spindle or be aligned with the outside spindle only on a side of the cavity and cam surface opposite the knob. As such, the outside spindle will have no camming structure and instead the inside spindle can define both the inclined cam surface for axially actuating the retracting piece and the actuator surfaces for rotatably actuating the retracting piece.

In still another embodiment, the slot through the wall of the inner spindle can be inclined relative to an axis of the spindle. As such, when the knob is rotated, an axially-directed force component will be communicated between edges of the slot and the pivot bolt head, forcing the outside spindle to move axially relative to the inner spindle. As such, in this embodiment rotation of the knob can move the cam surface of the outside spindle axially so as to actuate the retractor. In such an embodiment, the inner spindle may not employ actuator surfaces.

Figure 16:
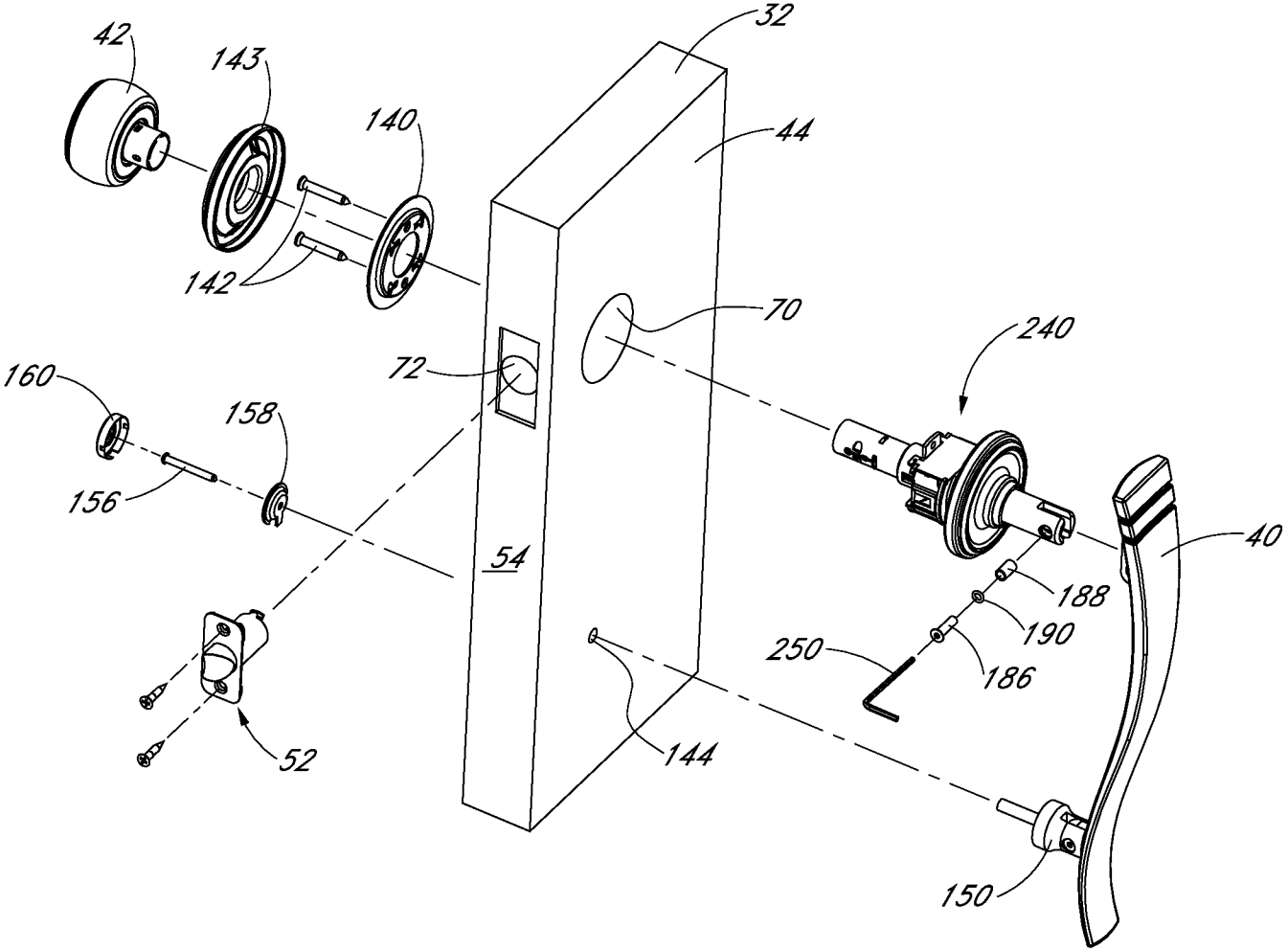
FIG. 16 is a partially exploded view of another embodiment of a handle set having features similar to the embodiment illustrated in FIG. 1.

With reference next to FIG. 16, embodiments having structure as described in connection with the features described herein can be provided as a kit for simplified installation by a user. In one such embodiment, the kit may be provided with a preassembled spindle and retractor assembly 240 upon which the outside rose 130 is also preassembled. In this embodiment, the outside rose 130 is threaded onto the spindle and retractor assembly 240 so that it can be threadingly moved between positions that correlate to how the spindle and retractor assembly 240 should be positioned when installed in doors of two standard door widths. In the illustrated embodiment, opposing ends of the threaded portion are blocked or bent to prevent the outside rose from being threaded beyond the opposing ends, and the blocked opposing thread ends correspond to the preset positions for the two door widths. Thus the outside rose can be quickly and threadingly moved from a first standard door width position to a second standard door width position.

Continuing with reference to FIG. 16, preferably the user is instructed to first install the latch bolt assembly 52 into the latch bolt hole 72 and then slide the preassembled spindle and retractor assembly 240 into the primary hole mount 70 so that the retractor's latch engagement portion 90 suitably engages the latch bolt assembly 52. The user is also instructed to position the outside rose 130 at the correct door width position. The inside mount plate 140 can then be bolted to the preassembled retractor and spindle assembly 240 so as to sandwich the door 32 between the outside cover plate 130 and the inside mount plate 140. The inside rose 143 can then be attached, by threading or any other means, to cover the inside mount plate 140, and the inside knob 42 can be connected to the proximal end 64 of the inside spindle 60. In a preferred embodiment, the kit comes with the handle pivot mount 150 preassembled to the lower handle mounting tab 58. To install the outside handle 40, preferably the handle pivot mount 150 is first installed in the secondary mount hole 144. The outside handle 40 can then be pivoted so that the upper handle mounting tab 56 fits into the outer spindle mount channel 172 and the bushing 188, O-ring 190, and pivot bolt 184 can be installed into the mount hole from one side and tightened by a tool such as an Allen wrench 250 to complete the installation.

The embodiments discussed above have been depicted as using a simple and typical latch bolt assembly 52. It is to be understood that any acceptable one of a range of latch bolt assemblies can be used.

The embodiments discussed above have disclosed structures with substantial specificity. This has provided a good context for disclosing and discussing inventive subject matter. However, it is to be understood that other embodiments may employ different specific structural shapes and interactions.

Although inventive subject matter has been disclosed in the context of certain preferred or illustrated embodiments and examples, it will be understood by those skilled in the art that the inventive subject matter extends beyond the specifically disclosed embodiments to other alternative embodiments and/or uses of the invention and obvious modifications and equivalents thereof. In addition, while a number of variations of the disclosed embodiments have been shown and described in detail, other modifications, which are within the scope of the inventive subject matter, will be readily apparent to those of skill in the art based upon this disclosure. It is also contemplated that various combinations or subcombinations of the specific features and aspects of the disclosed embodiments may be made and still fall within the scope of the inventive subject matter. Accordingly, it should be understood that various features and aspects of the disclosed embodiments can be combined with or substituted for one another in order to form varying modes of the disclosed inventive subject matter. Thus, it is intended that the scope of the inventive subject matter herein disclosed should not be limited by the particular disclosed embodiments described above, but should be determined only by a fair reading of the claims that follow.

What is claimed is:

1. A lockset, comprising:

a retractor assembly configured to be fit within a door mount hole and configured to be operably coupled to a latch bolt assembly and to selectively retract a latch bolt of the latch bolt assembly when a retractor of the retractor assembly is urged in an actuating direction;

first and second elongated spindles extending through the retractor assembly, the first and second elongated spindles being axially connected to one another such that the first and second spindles move axially together as a unit, the second spindle being rotatable relative to the first spindle, the first elongated spindle defining a first actuator surface and the second elongated spindle defining a second actuator surface;

wherein when the first and second elongated spindles move axially in a first direction, the first actuator surface is placed into engagement with the retractor of the retractor assembly so as to urge the retractor in the actuating direction; and wherein when the second spindle is rotated relative to the first spindle the second actuator surface is placed into engagement with the retractor of the retractor assembly so as to urge the retractor in the actuating direction.

2. A lockset as in claim 1, wherein the first actuator surface is formed on the first elongated spindle and the second actuator surface is formed on the second elongated spindle.

3. A lockset as in claim 2, wherein the first elongated spindle is connected to a first mounting tab of an elongated handle, and the elongated handle has a second mounting tab configured to be pivotably connectable to a door, and the first mounting tab defines a slot therein oriented in a direction to accommodate a distance between the second mounting tab and axes of the first and second elongated spindles.

4. A lockset as in claim 3, wherein the second elongated spindle is rigidly connectable to a knob.

5. A lockset as in claim 1, wherein the first and second actuator surfaces are both formed on one of the first and second elongated spindles.

6. A lockset as in claim 1, wherein one of the first and second spindles comprises a hollow distal end and the other of the first and second spindles comprises an overlap portion sized to extend into and be supported within the hollow distal end.

7. A lockset as in claim 6, wherein the overlap portion comprises a fastener receiver formed in a wall thereof, and the hollow distal end has an elongated slot formed through a wall thereof about a portion of its circumference.

8. A lockset as in claim 7, wherein when the overlap portion is disposed within the hollow distal end, the fastener receiver is aligned with the slot, and a spindle bolt is disposed within the fastener receiver so that a head of the spindle bolt is disposed within the slot and is raised from a surface of the overlap portion.

9. A lockset as in claim 8, wherein the head of the spindle bolt is axially aligned with an edge of the slot so that if the hollow distal end is moved axially the slot edge will be blocked from moving past the spindle bolt.

10. A lockset as in claim 9, wherein the first and second spindles are rotatable relative one another over a range of rotation, and the spindle bolt remains within the slot during such rotation.

11. A lockset as in claim 10, wherein the range of rotation is defined by opposing ends of the slot.

12. A lockset as in claim 10, wherein the first actuator surface comprises an inclined cam surface, and the second actuator surface comprises an axially-directed surface that is configured to move in the actuating direction when the second spindle is rotated relative to the first spindle.

13. A lockset as in claim 12, additionally comprising an elongated handle having spaced apart first and second mounting tabs, the first mounting tab being connected to the first spindle, the second mounting tab being pivotably connectable to a door.

14. A lockset as in claim 13, wherein the first mounting tab comprises an elongated slot, and the first spindle can be attached to the first mounting tab at any point along a length of the elongated slot.

15. A lockset, comprising:

a retractor assembly configured to be fit within a door mount hole and configured to be operably coupled to a latch bolt assembly and to selectively retract a latch bolt of the latch bolt assembly when a retractor of the retractor assembly is urged in an actuating direction;

an elongated spindle extending through the retractor assembly and defining an inclined cam surface;

an elongated handle having first and second spaced apart mounting tabs, the second mounting tab being pivotably mountable on an inwardly-opening door, the first mounting tab being mountable to an end of the elongated spindle;

wherein when the elongated handle is pushed so that it pivots about the second mounting tab, the first mounting tab moves in a generally axial direction so that the elongated spindle also moves in the generally axial direction; and wherein when the spindle moves in the generally axial direction, the inclined cam surface engages the retractor of the retractor assembly and urges the retractor in the actuating direction so as to retract the latch bolt.

16. A lockset as in claim 15, wherein the first mounting tab comprises an elongated slot, and the spindle is attached to the first mounting tab at a point along the elongated slot, the elongated slot extending in a direction transverse an axis of the spindle.

17. A lockset as in claim 16, wherein the spindle comprises an elongated channel configured to receive the first mounting tab, a first hole formed through the spindle on a first side of the channel and a second hole formed at least partially through the spindle on a second side of the channel and aligned with the first hole, the second hole being threaded and having a diameter smaller than a diameter of the first hole, an elongated hollow bushing extending through the first hole, the elongated slot of the first mounting tab and engaging the second side of the channel, an elastomeric O-ring abutting an end of the hollow bushing, a bolt extending through the hollow bushing and threadingly engaged with the second hole, and a head of the bolt urging the O-ring into engagement with the end of the hollow bushing, wherein the hollow bushing, O-ring, and bolt are all inserted through the first hole.

18. A lockset as in claim 16, wherein a connector extending through the first mounting tab elongated slot connects the elongated spindle to the first mounting tab, and the first mounting tab is configured so that when the elongated handle pivots about the second mounting tab the connector slides within the elongated slot.

19. A lockset as in claim 18, wherein the connector and first mounting tab are configured so that when the elongated handle pivots about the second mounting tab an axial component of handle movement is communicated to the elongated spindle but a vertical component of handle movement is not communicated to the elongated spindle.

20. A lockset as in claim 15, wherein the elongated spindle comprises a mount channel configured to slidably receive the first mounting tab so that the first mounting tab slides within the mount channel when the elongated handle pivots about the second mounting tab.

21. A lockset as in claim 20, wherein the first mounting tab is configured to have an axial and a vertical component of movement when the elongated handle is pivoted about the second mounting tab, and the first mounting tab and mount channel are configured so that the axial component of movement is imparted to the elongated spindle but the vertical component of movement is not imparted to the elongated spindle.

* * * * *